US005341719A

United States Patent [19]

Bullis et al.

[11] Patent Number: 5,341,719

[45] Date of Patent: Aug. 30, 1994

[54] MULTI-LAYER COMPOSITE GUN BARREL

[75] Inventors: Stephen J. Bullis, Colchester; David P. Perrin, Hinesburg; Peter C. Wolff, Milton, all of Vt.

[73] Assignee: General Electric Company, Philadelphia, Pa.

[21] Appl. No.: 990,107

[22] Filed: Dec. 14, 1992

[51] Int. Cl.[5] ..... F41A 21/02

[52] U.S. Cl. ..... 89/16; 89/14.05

[58] Field of Search ..... 89/16, 14.05

[56] References Cited

U.S. PATENT DOCUMENTS 1,355,421 10/1920 Pedersen ..... 89/16
2,780,019 2/1957 Sullivan ..... 89/16
3,566,741 3/1971 Sliney ..... 89/16
4,669,212 6/1987 Jackson et al. ..... 89/16
4,756,677 7/1988 Hribernik et al. ..... 89/16
4,911,060 3/1990 Greenspan et al. ..... 89/14.05
5,160,802 11/1992 Moscrip ..... 89/16
5,207,776 5/1993 Pearce ..... 164/98

*Primary Examiner*—David H. Brown
*Attorney, Agent, or Firm*—Geoffrey H. Krauss

[57] ABSTRACT

A multi-layer composite gun barrel has an integral metal alloy jacket portion, forming the exterior cylinder of the entire barrel, with a forebarrel interior liner cylinder substantially bonded within the jacket portion, and an unbonded breech portion liner, made from a high melting temperature refractory metal alloy able to resist erosion by hot gun gases in the barrel breech area.

10 Claims, 1 Drawing Sheet

MULTI-LAYER COMPOSITE GUN BARREL

The present invention was developed under a contract DAAA21-88-C-0036 with the U.S. Government, which has certain rights in this invention.

BACKGROUND OF THE INVENTION

The present invention relates to a gun barrel capable of achieving satisfactory life when firing high-energy ammunition and, more particularly, to a novel multi-layer composite gun barrel having a co-extruded composite multi-layered fore portion and a lined multi-layered breech portion.

Gun barrels are highly stressed by a combination of pressures up to 100,000 psi and very severe cycles resulting from temperature changes of several million °F per second. Current forms of gun barrels have relatively low lives. As larger quantities of high flame temperature propellant are used to achieve higher ammunition performance, the demand on the barrels becomes much greater, particularly for multiple rounds fired in a short time interval. The demand on the gun barrel during long bursts can be broken down into two distinct regions—the bore surface and the outer jacket. The bore surface experiences extreme variations in temperature which causes almost immediate cracking and the beginning of low cycle fatigue failures. High energy ammunition and high flame temperature propellant greatly accelerate these problems. High temperatures also cause loss of protective chrome plate, melting, and subjects the bore to hot gas erosion. Under these conditions, the barrel must still resist stresses created during engraving of the rotating band, projectiles which are launched into the barrel and high velocity projectile contact with the barrel. In conventional projectiles which are spun up in the barrel, the bore must withstand the stresses from a spinning projectile, which can result in sever balloting and body engraving in hot thermally expanded bores. The bore must still be able to withstand attack by chemical compounds after having been left under high tensile stresses due to compressive yielding during firing. This stress corrosion frequently causes propagation of deep cracks.

The outer portion of the barrel, on the other hand, has a relatively kinder environment with less rapid changes in temperature and stresses. However, the outer portion of the barrel must withstand the high pressure transmitted through the severely degraded bore surface, and must maintain a high modulus of elasticity to maintain low bore expansion and axial stiffness during firing. The barrel outer, or jacket, portion must have good cleanliness and fracture toughness to prevent rapid crack growth after propagation from the bore surface, which can lead to rupture. Unfortunately, these characteristics must be achieved over a significant temperature range, which will cause yielding during most firing bursts. The coefficient of thermal expansion of the jacket becomes particularly important in limiting bore growth when the barrel jacket gets hot.

The obvious solution to the extremely different conditions of the bore surface and the jacket portion is to utilize a composite barrel with optimum properties for each region. Many concepts have been advanced for achieving the desired configuration, including concepts which provide a good bond between the boreliner and the jacket. However, none of these designs has provided a good low cost method of achieving acceptable erosion rates in the breech end of the barrel and good concentricity between the liner and jacket in the bonded forward section, or fore portion, of the barrel. Good concentricity is required to prevent barrel bending due to differential expansion. It is therefore highly desirable to provide a relatively low cost multi-layer composite gun barrel with acceptable breech end erosion and concentricity attributes.

BRIEF SUMMARY OF THE INVENTION

In accordance with the invention, a multi-layer composite gun barrel combines an integral metal alloy jacket portion, forming the exterior cylinder of the entire barrel, having an unbonded breech portion liner, made from a high melting temperature refractory metal alloy able to resist erosion by hot gun gases in the barrel breech area, with a forebarrel interior liner cylinder substantially bonded within the jacket portion. The integral forebarrel portion is thus comprised of a liner material, which offers suitable resistance to erosion forward of the breech liner where heat inputs and temperatures are lower, bonded to and concentric with a low expansion jacket material with good elevated temperature strength. A new composite gun barrel is thus provided for weapons firing high velocity projectiles, yet achieving satisfactory erosion/fatigue life in a gun using high-energy ammunition.

In a present preferred embodiment of the present invention, the gun barrel combines: an unbonded breech liner made from a very high melting temperature and ductile material, such as Ta-10 W, which resists erosion by hot gun gases; a jacket made of a low expansion material with good elevated temperature strength, such as IN-909; and an integral forebarrel bore liner formed of an erosion resistant bore surface material, selected from 1) a medium alloy steel such as CrMoV, which will subsequently be chrome plated, 2) a cobalt base alloy with high chrome content such as Stellite 21, or 3) a nickel base alloy with high chrome content such as IN-718. This multi-layer barrel allows the weapons designer to combine the best available liner and jacket materials by using both a bonded forebarrel liner and unbonded breech liner. The bonded forebarrel liner provides excellent concentricity (i.e., with less than 10% deviation from perfect roundness) of the interface between the two materials, the bore surface, and the outside diameter.

Accordingly, it is one object of the present invention to provide a novel composite multi-layer gun barrel.

This and other objects of the present invention will become apparent to those skilled in the art, upon reading the following detailed description of the preferred embodiments, when considered in conjunction with the associated drawings.

DETAILED DESCRIPTION OF THE PREFERRED EMBODIMENTS

Figure 1:
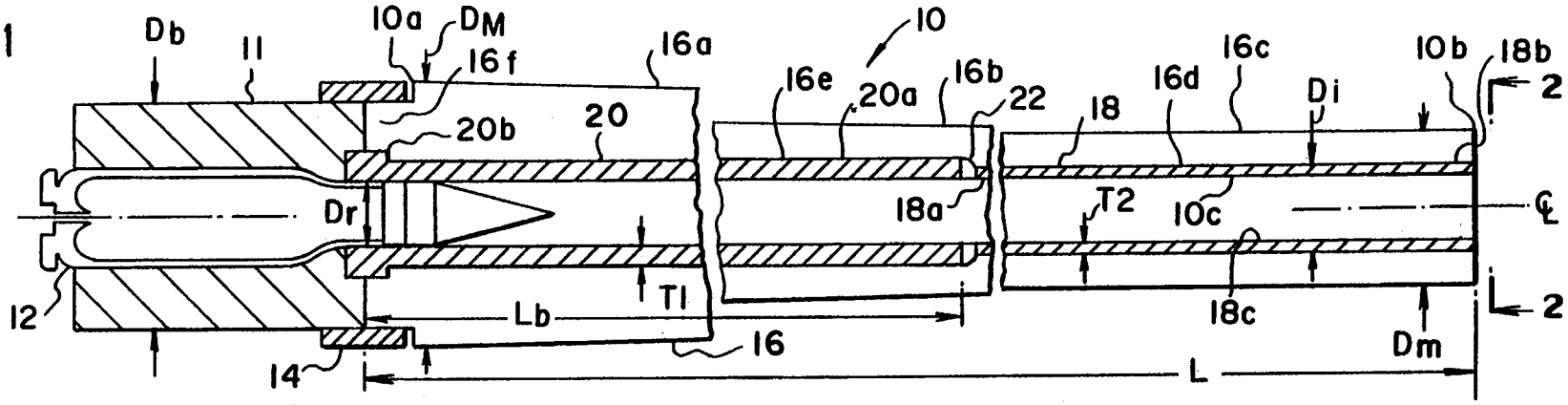
FIG. 1 is a sectional side view of a composite multi-layer gun barrel in accordance with the invention.
Figure 2:
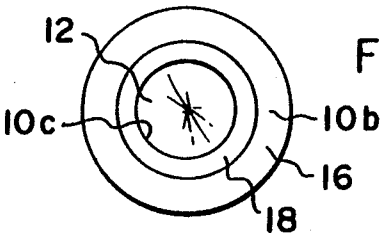
FIG. 2 is an end view of the foreportion barrel end.

Referring initially to FIGS. 1 and 2, a gun barrel 10 is formed with a breech portion 10*a* on the opposite end from a muzzle, or fore, portion 10*b*. The breech portion operates with a chamber member 11, holding a shell 12 in firing position within the breech, and maintained in position by suitable means, such as ring member 14 and the like.

In accordance with the invention, barrel 10 is comprised of an outer, or external, jacket portion 16, extending the full length L of the barrel (forward of chamber member 11), and thus having a barrel breech portion 16*a*, of maximum diameter $D_M$, tapering at least through a barrel midportion 16*b*, to a barrel foreportion 16*c*, of minimum diameter $D_m$; the barrel portions 16*a* and 16*c* may also be tapered. The barrel jacket portion surrounds a liner layer 18, metallurgically bonded to the jacket interior surface 16*d*. The jacket/liner portions are formed from a tubular coextrusion cylinder of concentric material layers carefully selected to include compatible materials, such as nickel, iron and cobalt base superalloys. The liner portion 18 is replaced, along a length $L_b$ of the barrel breech portion, with a borelining cylinder 20 (preferably, length $L_b$ is less than one-fourth of the barrel length L); a small expansion portion 22 (of perhaps 50 milli-inches length or less) may be provided between a foreportion 20*a* of the boreliner and the forelayer 18 rear portion 18*a*, for accommodation of liner portion 20 expansion. The unbonded boreliner portion 20 also has a breech portion 20*b* serving to retain the "floating" boreliner sleeve within the jacket breech bore 16*e*. The boreliner portion 20 can be fabricated of a more expensive high density refractory metal alloy which can withstand the very high breech temperature. The boreliner portion 20 would normally have an average thickness T1 greater than the average thickness T2 of the forebarrel liner portion.

Referring now to FIGS. 3*a*–3*d*, the barrel 10 is fabricated from a co-extruded barrel tube 24 (e.g. a co-extruded tube obtained from INCO Alloys International, Inc., Huntington, W. Va. 25720) with an INCO IN-909 iron-based alloy jacket 16 surrounding and metallurgically joined to an INCO IN-718 nickel-based alloy liner 18, with both the inside and outside of the tube being formed within one coextrusion die, to provide a high degree of concentricity of the interface diameter $D_i$ to both the liner bore surface 18*c* and the OD of the jacket portion 16. The co-extruded barrel cylinder may also be formed of other alloy combinations, including: liner layer 18 of one of the aforementioned IN-718, or one of CrMoV steel, PYROMET 31 or Stellite 21 alloys, and the like; and jacket layer 16 of the aforementioned IN-909, or one of IN-908 or Haynes 242 alloys, and the like, in combinations as selected for providing the desired concentric, bonded layers for achieving a particular end barrel result. The IN-718 liner alloy has sufficiently high chromium content to offer good erosion resistance to hot gun gasses. The IN-909 jacket was selected for its low thermal expansion and good elevated temperature strength. This particular combination of materials was also selected, in part, because of the relatively good compatibility of these two alloys regarding deformation at elevated temperature, facilitating coextrusion, and heat treatment.

Figure 3A:
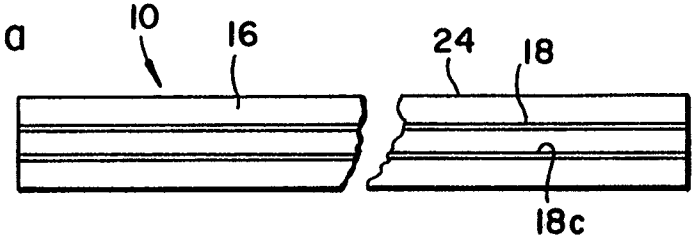
FIGS. 3*a*–3*d* are a set of side sectional views showing progressive fabrication of the composite multi-layer barrel from a metallurgically-bonded dual-layer integral cylinder.
Figure 3B:
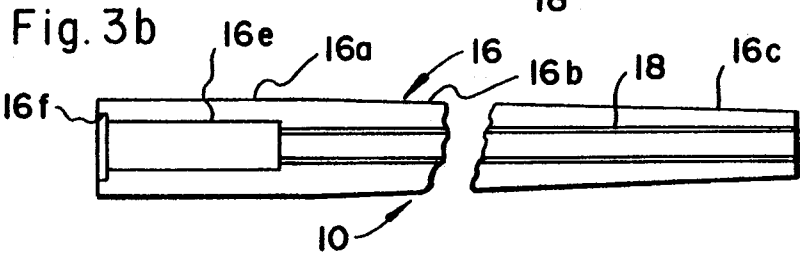
Figure 3C:
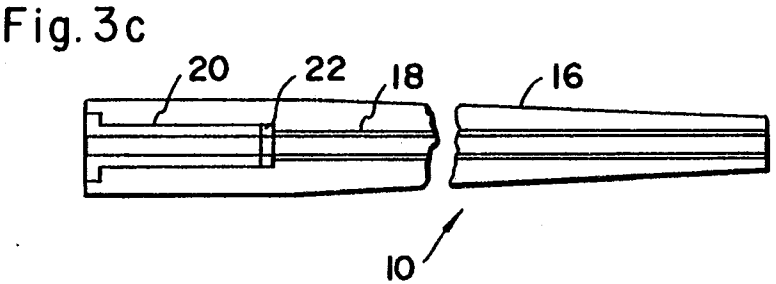
Figure 3D:
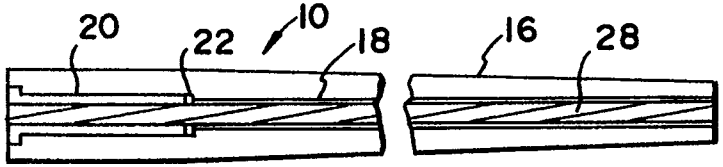

The raw cylinder outer surface is (as shown in FIG. 3*b*) now machined to form the breech portion 16*a*, the midportion 16*b*, and the desired muzzle portion 16*c*. A boreliner portion 16*e* is bored to a depth of slightly more than length $L_b$ and with an average diameter of about ($D_r$+2T1) and the larger-diameter breech end portion 16*f* is then machined into the sleeve breech portion 16*a*. The breech boreliner portion 20 was separately formed (of an alloy material such as Ta-10W, FS-85, FS-752, WC-3009 and the like) and finished, and is now shrunk-fit into the expanded bore portion 16*e* (FIG. 3*c*). Thereafter, the undersized bore is machined (FIG. 3*d*) to add any desired rifling lands and grooves 28 and to bring the diameter up to the required caliber. Then the bore of the forebarrel liner portion 18 can be plated, as desired, with a chromium or carbo-nitride film, to add corrosion resistance.

While presently preferred embodiments of our novel multilayer composite gun barrel are described herein, many variations and modifications will now become apparent to those skilled in the art. It is our intent, therefore, to be limited only by the scope of the appending claims, and not by the specific details and instrumentalities included herein by way of explanation.

What we claimed is:

1. A gun barrel comprising a full-length jacket portion of a first alloy, having a multi-layer forebarrel portion wherein the jacket portion is substantially metallurgically bonded to a relatively thick liner portion formed of a second alloy, coextruded within the jacket portion to have a highly-concentric tubular interface, and with an interface diameter $D_i$ relatively greater than the diameter of the barrel bore.

2. The gun barrel of claim 1, wherein the jacket portion alloy is selected to have a relatively low coefficient of temperature expansion with respect to the coefficient of temperature expansion of the material of the liner portion.

3. The gun barrel of claim 2, wherein the liner portion alloy is selected to have a relatively high degree of hot gas erosion resistance with respect to the hot gas erosion resistance of the material of the jacket portion.

4. The gun barrel of claim 3, wherein at least one of the first and second alloys is an alloy having a base of at least one selected one or iron, nickel and cobalt.

5. The gun barrel of claim 3, wherein both of the first and second alloys are alloys having a base of at least one selected one of iron, nickel and cobalt.

6. The gun barrel of claim 1, further comprising an unbonded breech boreliner in the breech end of the barrel jacket portion, enclosing at least a portion of a firing chamber therein and extending forward from said chamber toward the muzzle.

7. The gun barrel of claim 6, wherein the exterior surface of the breech boreliner portion has an average diameter greater than the interface diameter $D_i$ between the liner and jacket portions of the barrel foreportion.

8. The gun barrel of claim 6, wherein the boreliner portion has a bore length $L_b$ of less than one-quarter of the total length L of the barrel.

9. The gun barrel of claim 6, wherein the breech boreliner is formed of a third alloy.

10. The gun barrel of claim 9, wherein the third alloy is a refractory metal having a higher resistance than either of the first and second alloys to erosion by hot gun gases.

* * * * *